US011186429B2

(12) United States Patent
Accursi

(10) Patent No.: US 11,186,429 B2
(45) Date of Patent: Nov. 30, 2021

(54) CAPSULE FOR MAKING BEVERAGES

(71) Applicant: CAFFITALY SYSTEM S.p.A., Gaggio Montano-Bologna (IT)

(72) Inventor: Giovanni Accursi, Porretta Terme (IT)

(73) Assignee: Caffitaly System S.p.A., Gaggio Montano-Bologna (IT)

( * ) Notice: Subject to any disclaimer, the term of this patent is extended or adjusted under 35 U.S.C. 154(b) by 1177 days.

(21) Appl. No.: 15/083,445

(22) Filed: Mar. 29, 2016

(65) Prior Publication Data

US 2016/0207698 A1 Jul. 21, 2016

Related U.S. Application Data

(62) Division of application No. 14/405,526, filed as application No. PCT/IB2013/054659 on Jun. 6, 2013, now abandoned.

(30) Foreign Application Priority Data

Jun. 8, 2012 (IT) ..... VR2012A000121

(51) Int. Cl.
*B65D 85/804* (2006.01)

(52) U.S. Cl.
CPC ..... *B65D 85/8043* (2013.01); *B65D 85/8046* (2013.01)

(58) Field of Classification Search
CPC ..... B65D 85/8043; B65D 85/804; B65D 85/8046; A47J 31/0673; A47J 31/407; A47J 31/3628
See application file for complete search history.

(56) References Cited

U.S. PATENT DOCUMENTS 5,824,218 A * 10/1998 Gasser ..... A47J 31/0663 210/337
2006/0236871 A1* 10/2006 Ternite ..... B65D 85/8043 99/295

(Continued)

FOREIGN PATENT DOCUMENTS

EP 1364605 A1 * 11/2003 ..... A47J 31/3628
WO WO-2011004269 A1 * 1/2011 ..... A47J 31/303

OTHER PUBLICATIONS

Rigid Google Defintion. Jun. 4, 2012. Retrieved from: <https://www.google.com/search?q=rigid&rlz=1C1GCEA_enUS796US796&source=lnt&tbs=cdr%3A1%2Ccd_min%3A%2Ccd_max%3A6%2F4%2F2012&tbm=>.*

*Primary Examiner* — Erik Kashnikow
*Assistant Examiner* — Ashley Axtell
(74) *Attorney, Agent, or Firm* — Maginot, Moore & Beck, LLP

(57) ABSTRACT

A capsule containing a powdered food substance comprises a body including a lower wall and a lateral wall, and a lid fixed to the body. The lid and a central portion of the lower wall are pierceable to allow the injection of water into and the extraction of a beverage from the capsule. Between the lid and the lower wall, there is a permeable filter, which retains the powdered substance, the filter including a layered sheet of flexible material fixed to the body, and separating the powdered substance from the central portion. The sheet of flexible material is shaped to form, at the central portion, at least one projection towards the lid. At the projection the filter is distanced from the central portion and there is a compartment, located between the filter and the central portion, where a piercing element can be inserted following penetration through the central portion, without damaging the filter.

5 Claims, 3 Drawing Sheets

(56) References Cited

U.S. PATENT DOCUMENTS

| | | | | |
|---|---|---|---|---|
| 2010/0129512 | A1* | 5/2010 | Accursi | A47J 31/0673 426/431 |
| 2010/0173055 | A1* | 7/2010 | Brouwer | A47J 31/0678 426/433 |
| 2011/0064852 | A1* | 3/2011 | Mann | B65D 85/8043 426/78 |
| 2011/0097450 | A1* | 4/2011 | Kruger | B65D 85/8043 426/77 |
| 2013/0059039 | A1* | 3/2013 | Trombetta | B65B 29/022 426/82 |

* cited by examiner

CAPSULE FOR MAKING BEVERAGES

REFERENCE TO RELATED APPLICATION AND PRIORITY CLAIM

This application is a divisional application of and claims priority to co-pending U.S. application Ser. No. 14/405,526, filed on Dec. 4, 2014, which is a § 371 national stage application of international application No. PCT/IB2013/054659, having an international filing date of Jun. 6, 2013, which claims priority to Italian application No. VR2012A000121, filed on Jun. 8, 2012.

TECHNICAL FIELD

This invention relates to a capsule for making beverages.

In particular reference is made to those capsules comprising a body and a lid which closes the top of the body. Inside the capsule there is a powdered food substance (for example coffee powder), which can be extracted by passing water (which may be pressurised) through it to make a beverage, for example coffee. More specifically reference is made to those capsules in which the body comprises a lower wall and a lateral wall, and which inside them have a filter interposed between the lower wall and the lid for separating the powdered food substance at least from a relevant portion of the lower wall.

In more detail, reference is made to those capsules suitable for use in beverage making systems in which the capsule is pierced at the lid, to allow the injection of water (which may be pressurised) into the capsule itself, and at a central portion of the lower wall (the relevant portion), to allow dispensing to the outside of the capsule of the beverage produced by the interaction of the water with the powdered food substance. In such capsules the filter is positioned close to the lower wall so that the capsule can contain a larger quantity of powdered food substance between the lid and the filter.

BACKGROUND

An example of such a type of capsule is given in patent US 2006/0236871 which describes a capsule comprising a filter composed of a rigid skeleton having a conical central projection in which a piercing spike is inserted after piercing the lower wall. In said rigid skeleton openings are made, covered by a fabric permeable to the beverage, through which the beverage can pass in order to then flow out of the capsule through the lower wall (through the gap made after piercing of the lower wall).

However, rigid or semi-rigid filters have high production costs linked first to the mould needed to make them. The production of rigid or semi-rigid filters having complex structures, for example in which openings, holes or passages are made, or projections, further increases the production costs. Moreover, added to those costs are the costs directly linked to the intrinsic cost of the material used to make the filter.

Therefore, herein reference is made to those capsules in which the filter is instead substantially made of a flexible material such as paper, fabric, non-woven fabric, etc.

For example, on the market there are capsules which on the inside have a flat fabric filter, fixed to the lower wall, which is permeable to the beverage and at the same time can retain the powdered food substance. Such capsules are suitable for use with beverage making systems in which the element for piercing the lower wall penetrates inside the capsule, remaining there for the duration of beverage dispensing which, advantageously, takes place through channels made in the piercing element itself.

Another example is given in patent US 2012/0070551 which describes a capsule in which, lying at the lower wall, there is a filter made of a layer of non-woven fabric which separates the powdered food substance from the lower wall of the capsule. In particular, in one embodiment, said layer is oversized and after capsule penetration by a piercing element, through the lower wall, said layer is lifted relative to the lower wall by the piercing element, although the filter remains intact. Therefore, the beverage can pass through the filter and flow out of the capsule, for example through a duct made in the piercing element.

However, in some cases the filter may be damaged, for example cut by the piercing element, although the outflow of powder is substantially prevented by the interference between the piercing element and the edges of the filter surrounding the cut made by it.

However, this prior art technology has several disadvantages.

In fact, capsules such as those described above are not compatible with all beverage making systems and in particular they are not compatible with some capsule lower wall piercing methods. In fact, in systems in which the piercing element is particularly sharp, or in systems in which the thrust applied by the piercing element on the lower wall is particularly great, the piercing element can easily cause a tear in the filter.

For example, in beverage making systems of the type described in EP 2000063 which use a cutting element that first penetrates the lower wall of the capsule, causing a clean and linear cut, and immediately afterwards is uncoupled from it, leaving a gap, the filter positioned on the lower wall, in accordance with the known capsules, is easily pierced or torn. In such a situation, during the subsequent dispensing, together with the beverage part of the powdered food substance also comes out, making the beverage dispensed undrinkable and increasing the risk of blockage of the system dispensing pipes and of malfunctions in the devices connected to them.

SUMMARY

In this context, the technical purpose which forms the basis of this invention is to provide a capsule for making beverages which overcomes the above-mentioned disadvantages.

In particular, the technical purpose of this invention is to provide a capsule for making beverages which is equipped with a low cost filter and which is suitable for use according to the various methods for piercing or cutting the lower wall.

It is also the technical purpose of this invention to provide a capsule for making beverages which allows the filtering function of the filter to be kept intact, allowing a good quality beverage to be made The technical purpose specified and the aims indicated are substantially achieved by a capsule for making beverages as described in the appended claims.

BRIEF DESCRIPTION OF THE DRAWINGS

Further features and advantages of this invention are more apparent in the detailed description below, with reference to several preferred, non-limiting embodiments of a capsule for making beverages, illustrated in the accompanying drawings, in which.

DETAILED DESCRIPTION

Figure 1:
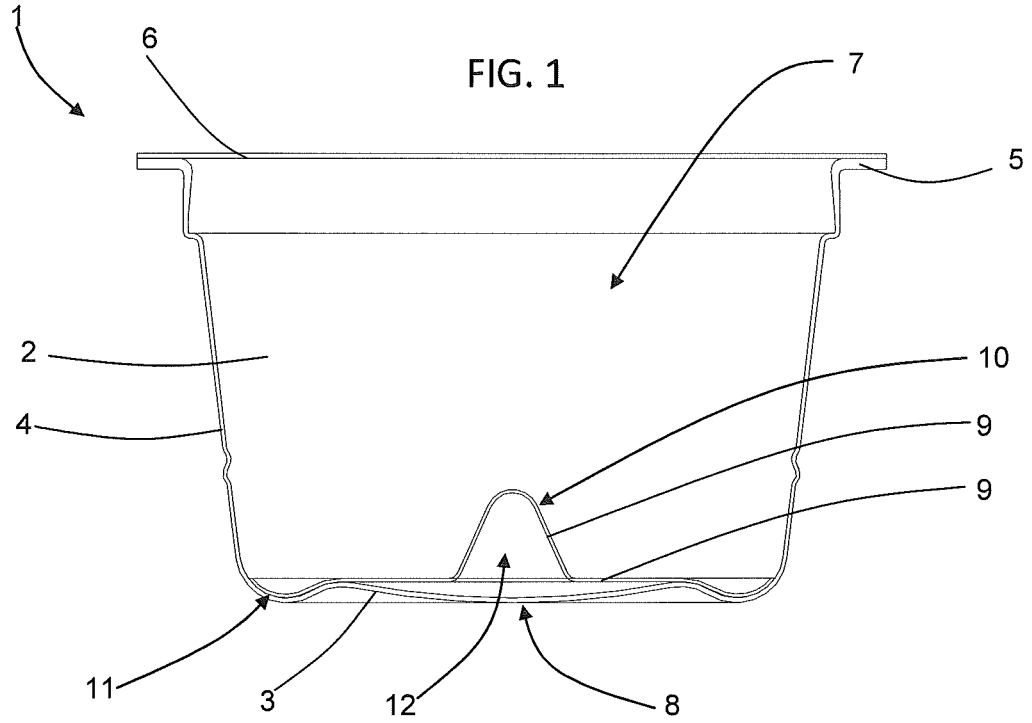
FIG. 1 is a vertical section of a first embodiment of a capsule in accordance with this invention.

With reference to the accompanying drawings, the numeral 1 denotes in its entirety a capsule for making beverages in accordance with this invention.

The capsule 1 in accordance with this invention contains at least one powdered food substance which can be extracted by passing water through it to make a beverage. The powdered food substance, for example powdered coffee, can be extracted for example by infusion or is soluble to make a beverage such as coffee or tea, infusions, soups, etc. The capsule 1 may if necessary be suitable for allowing extraction of the powdered food substance, for example coffee, by passing pressurised water through it, for example for making an espresso coffee.

The capsule 1 comprises a substantially cup-shaped body 2 comprising a lower wall 3 and a lateral wall 4. In the embodiments illustrated the lower wall 3 of the capsule 1 substantially extends in a circular fashion and the side wall 4 extends from it with a shape that to a first approximation is frusto-conical, the upper part of it ending with an edge 5 located on the opposite side to the lower wall 3. A lid 6 is fixed to the capsule 1 body 2 at the edge 5 and closes the top of the capsule 1 body 2. Between the lid 6 and the inner surface of the capsule 1 body 2 there is a chamber 7 for containing the powdered food substance.

The capsule 1 is therefore suitable for insertion in a beverage making system which advantageously comprises a housing in which the capsule 1 can be positioned for use for making a beverage. In particular the system, in the substantially known way, comprises injection means for injecting water into the capsule 1 and extraction means for extracting the beverage form the capsule 1.

For this invention the capsule 1 lid 6 is pierceable to allow the injection of water into the chamber 7, and the lower wall 3 is pierceable, at a central portion 8 of it, to allow extraction of a beverage from the capsule 1. Consequently, the beverage making system suitable for using a capsule 1 in accordance with this invention will have the injection means associable with the capsule 1 lid 6 and the extraction means associable with the capsule 1 lower wall 3 and in particular with a central portion 8 of the lower wall 3. The lower wall 3 of the capsule 1 according to this invention is therefore suitable for penetration by a piercing element, which refers to any element, substantially of the known type, able to pierce, cut or tear, for example a spike or a blade, fixed or mobile.

The capsule 1 also comprises a filter 9 at least mainly made of a layered sheet of flexible material positioned inside the chamber 7 close to the lower wall 3. The filter 9 separates the powdered food substance at least from the central portion 8 of the lower wall 3, and is permeable to the beverage, at the same time preventing the passage of powdered food substance. The filter 9 may therefore separate the powdered food substance from even a limited portion of the lower wall 3, substantially corresponding to the portion of lower wall 3 delimited by the substantially annular portion with which the filter 9 is associated. In the embodiment illustrated in the accompanying drawings, the filter 9 separates the powdered food substance substantially from the entire surface of the lower wall 3, the filter advantageously being associated with a substantially annular and marginal portion of the lower wall, close to the lateral wall 4, or at the lateral wall 4 itself. However, if necessary the filter 9 may separate the powdered food substance even from a portion of lateral wall 4 adjacent to the lower wall 3 if it is fixed to the body 2 at the lateral wall 4.

In this context, the term flexible material refers to a material which is neither rigid nor semi-rigid, for example a plastic material, although it refers to a material which can be folded, rolled up on itself, folded over itself, and if necessary is soft and can have various degrees of deformability and has a texture such as paper, fabrics with various weaves and even polymers, a non-woven fabric, a thermoformable fabric, a plastic film, etc. However, such examples shall be understood to be provided by way of example only, without limiting a flexible material in accordance with this invention.

Therefore, the filter 9 may substantially be made of a layer of flexible material, such as those indicated above, in various shapes, for example mainly disk-shaped. In any case, this invention also covers filters made of two or more superposed layers (all flexible as indicated above), if necessary of different types, with different shapes or worked to take on various surface features and/or shapes.

The filter 9 is permeable to the beverage thanks to the material used to make it, for example a fabric permeable to the beverage and having a weave such that it retains the powdered food substance, and/or due to its shape, for example a disk, having through holes which allow the beverage to pass through it and at the same time retain the powder.

According to this invention the sheet of flexible material used to make the filter 9 is shaped to form at least one projection 10 towards the lid 6 substantially at the central portion 8 of the lower wall 3. At the projection 10, in particular, the filter 9 is distanced from the central portion 8 of the lower wall 3. In the embodiments illustrated in the accompanying drawings, the projection 10 is shaped like a protuberance, located at the centre of the filter 9 and at the central portion 8 of the lower wall 3, projecting relative to the substantially flat profile of the rest of the filter 9.

Moreover, advantageously, the projection 10 is capable of supporting itself, for example due to its shape, and/or the folding of the starting sheet of material used to make it, and/or its sturdiness and/or thanks to a local polymerisation process, etc.

Figure 2:
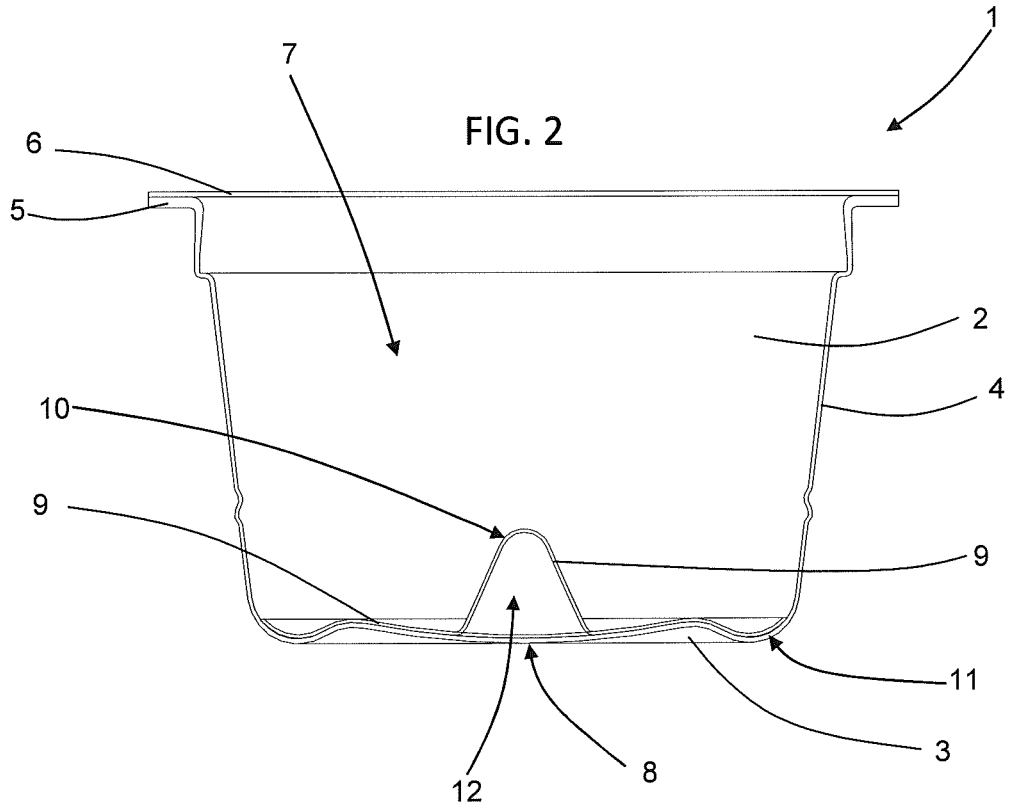
FIG. 2 is a vertical section of a first alternative embodiment of the capsule of FIG. 1.

The projection 10 may be made using various methods. However, in general, the process for making the projection may comprise a step of stretching, cold or hot deformation, local polymerisation (where permitted), etc. The projection 10 may also be made by making a crease in a flat starting piece of material or even by folding it. However, advantageously the process for making the projection 10 tends to strengthen it in such a way that it is able to support itself. As already indicated, in the preferred embodiments the filter 9 substantially covers the entire surface of the lower wall 3. However, the filter 9 may be in contact with the lower wall 3 only at several points, as shown in FIGS. 1, 3, 4 and 6, or it may rest on the lower wall 3 substantially adapting to it, except for on the central portion 8 (FIGS. 2 and 5). Therefore, advantageously, the filter 9 extends substantially on the entire surface of the lower wall 3 and rests on the latter except on the central portion 8 where there is the projection 10.

However, rather than substantially covering the entire surface of the lower wall 3, as in the embodiments illustrated, the filter 9 may in various ways be limited to covering more limited portions. For example it may cover just more than the central portion 8 only of the lower wall 3 which, during capsule 1 use, will be penetrated by a piercing, cutting or tearing element (embodiment not illustrated). In this case, advantageously, the filter 9 is substantially reduced only to the portion forming the projection 10.

In any case, the sheet of flexible material used to make the filter 9 is directly fixed to the capsule 1 body 2 at an annular portion 11 of the capsule 1 body 2, the annular portion 11 surrounding the central portion 8. Advantageously, the filter 9 is fixed to the body 2 by gluing or sealing.

The annular portion 11 may be located in different zones of the capsule 1 body 2, for example it may be located on the lower wall 3 around the central portion 8 and if necessary radially distanced from it, or it may be on the lateral wall 4, advantageously in a region adjacent to the lower wall 3.

Advantageously, in the preferred embodiment the sheet of flexible material is fixed to the lower wall 3 at an annular portion 11 surrounding the central portion 8. For example in the accompanying drawings the sheet of flexible material is fixed to the lower wall 3 at a peripheral annular portion 11 of it proximal to the lateral portion 4. Advantageously, in the accompanying drawings the sheet of flexible material is connected to the lower wall 3, and more precisely to the annular portion 11, at a portion of it which is also substantially annular and substantially corresponds to the perimeter of the sheet of flexible material. However, in other embodiments (not illustrated) the sheet of flexible material could be connected to the annular portion 11 at a portion of it which is substantially annular and radially further in than its own perimeter and in any case surrounding the portion of filter 9 corresponding to the projection 10.

Figure 3:
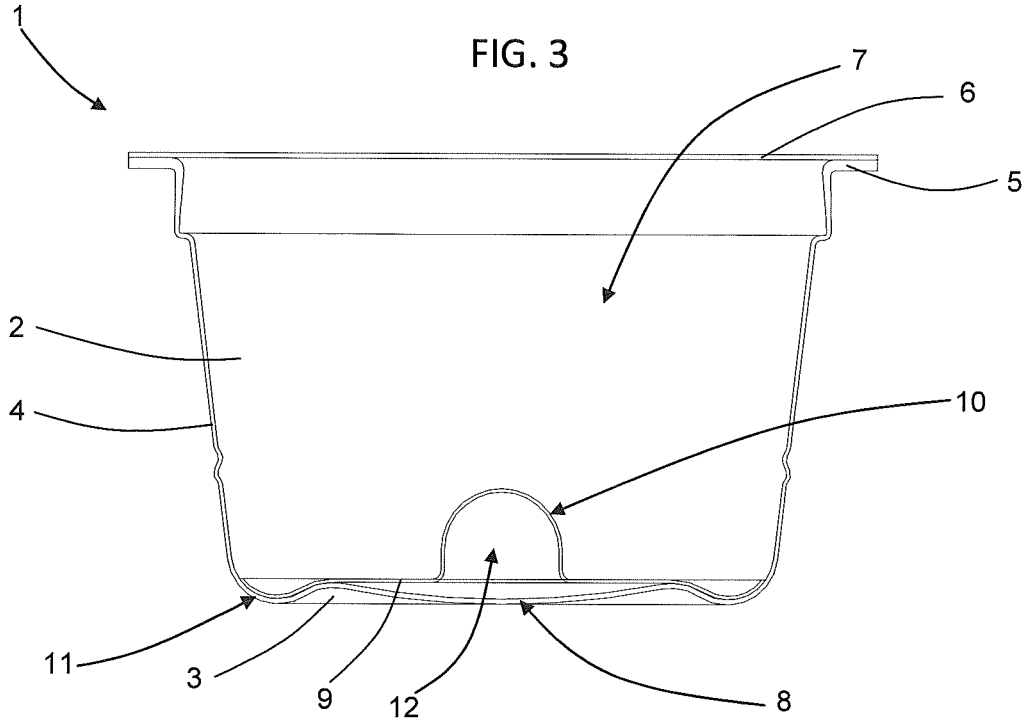
FIG. 3 is a vertical section of a second alternative embodiment of the capsule of FIG. 1.

As already indicated, the projection 10 may be obtained with various techniques, by shaping the starting sheet of material to form a hump which may be in a variety of shapes. In fact, the projection 10 may for example have a substantially conical shape (FIGS. 1, 2, 4 and 5) or it may be substantially dome-shaped (FIGS. 3 and 6).

As indicated, the filter 9 is distanced from the lower wall 3 at the projection 10. At the projection 10 there is a compartment 12, between the filter 9 and the central portion 8, where, in use, a piercing element can be inserted following penetration through the central portion 8 of the lower wall 3, without damaging the filter 9.

Therefore, the compartment 12 is formed between the portion of the sheet of flexible material forming the projection 10 and the central portion 8 of the lower wall 3. In fact, the projection 10 forms an empty space substantially corresponding to the volume of the compartment 12 which is of a size suitable for housing a piercing element which penetrates inside it, at the central portion 8 of the lower wall 3, without said piercing element being able to damage the filter 9, advantageously not making contact with the filter.

In the first embodiment described so far, the projection 10 can support itself and forms the compartment 12, delimiting it (with the central portion 8) and giving it shape and volume. In a second embodiment of this invention, illustrated in FIGS. 4, 5 and 6, between the portion of the sheet of flexible material forming the projection 10 and the lower wall 3 of the capsule 1 there is a supporting element 13 which supports the filter 9 at the projection 10 after pressures on it acting towards the lower wall 3. More precisely, the supporting element 13 is positioned on the lower wall 3 at the central portion 8. The supporting element 13 is advantageously made of rigid or semi-rigid material and allows the portion of the sheet of flexible material to be supported at the projection 10. Moreover, on its part in contact with the projection 10, the supporting element 13 preferably does not comprise edges or elements which could damage the filter 9 at the projection 10, for example after the simple pressure applied by the powdered food substance on the filter 9 or after the normal operating pressures generated inside the capsule 1 during its use.

The supporting element 13 is such that it does not interfere with the entry of a piercing element. The compartment 12 is advantageously located between the supporting element 13 and the lower wall 3 (in particular the central portion 8). In fact, in the preferred embodiment illustrated in FIGS. 4, 5 and 6, the supporting element 13, as described in more detail below, substantially completely forms the compartment 12, substantially delimiting its volume between itself and the central portion 8 of the lower wall 3. In other alternative embodiments (not illustrated) the supporting element 13 forms the compartment 12 together with the projection 10, that is to say, it is for example substantially configured as a rigid skeleton or a frame which does not substantially interfere with the volume of the compartment 12 which instead remains mainly delimited by the projection 10.

The supporting element 13 may be made with various shapes and structures. It is at least mainly substantially shaped to match the projection 10. Advantageously, as already indicated, the supporting element 13 allows the shape of the projection 10 to be maintained, keeping it substantially unchanged even after pressures applied on the filter 9 at it, acting towards the lower wall 3.

Figure 4:
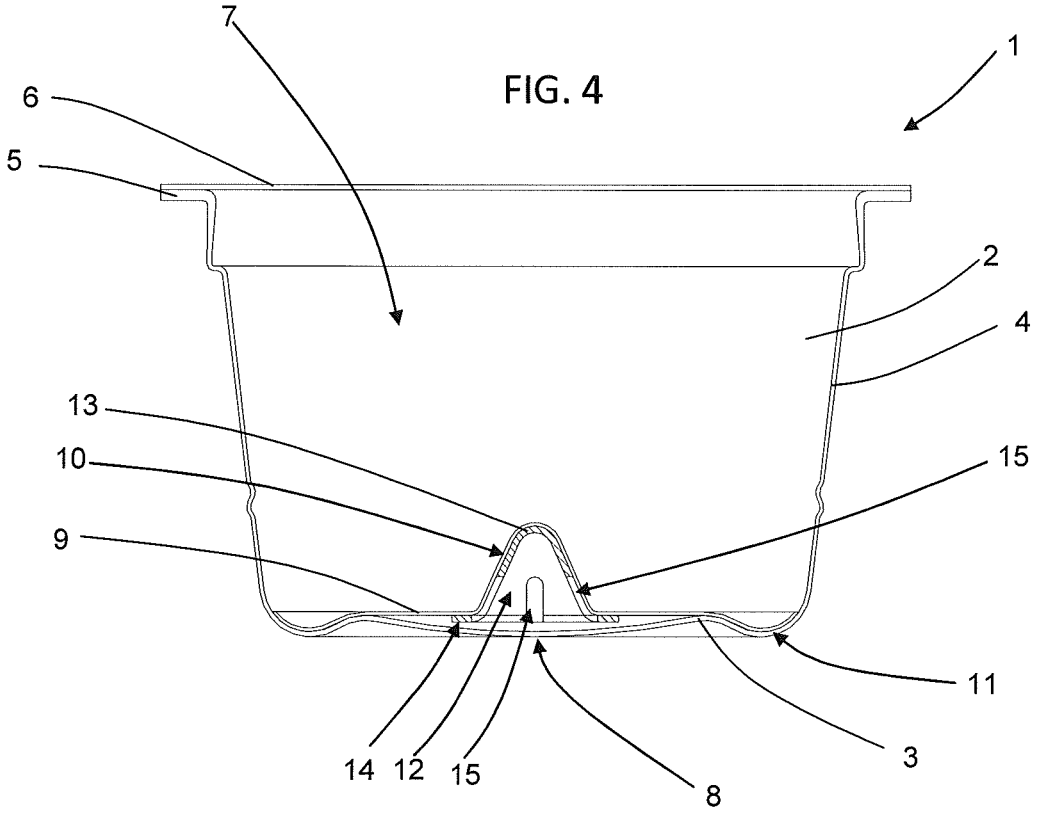
FIG. 4 is a vertical section of a second embodiment of a capsule in accordance with this invention.
Figure 5:
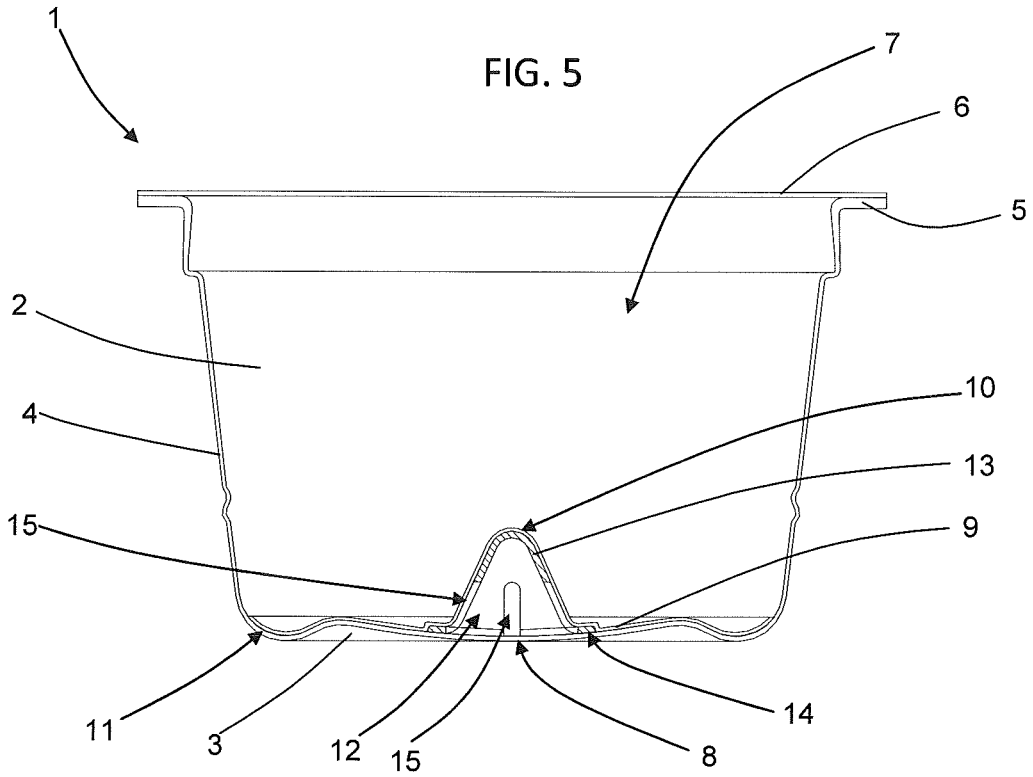
FIG. 5 is a vertical section of a first alternative embodiment of the capsule of FIG. 4.
Figure 6:
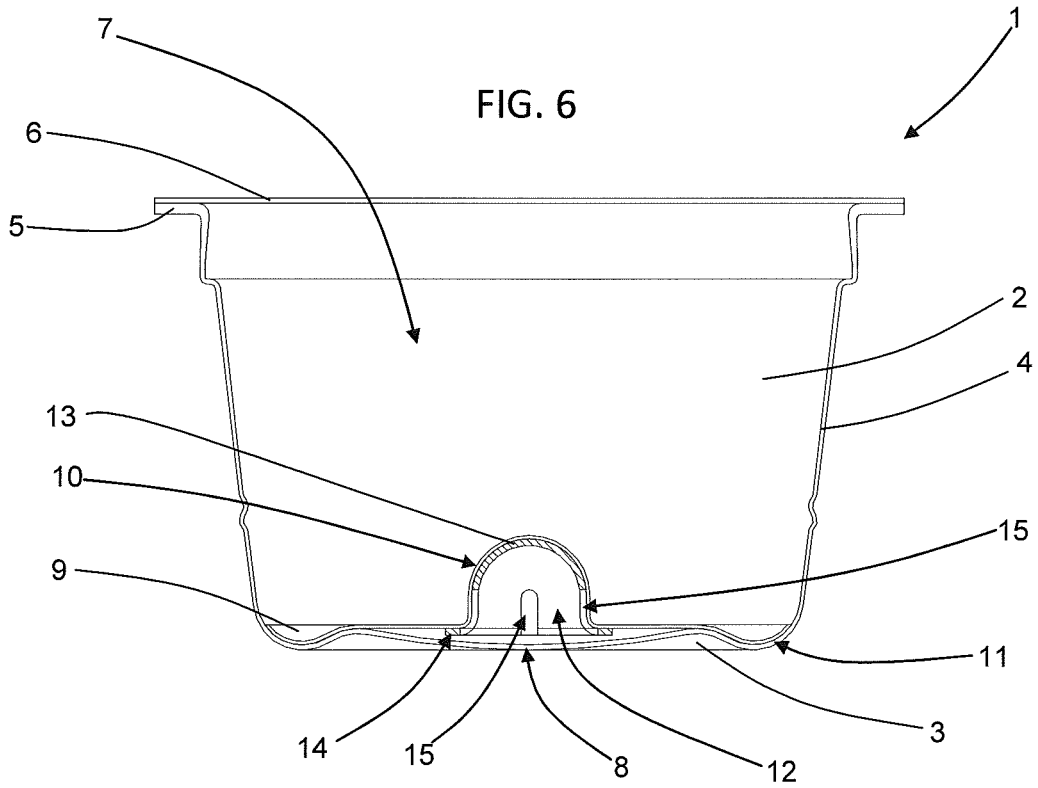
FIG. 6 is a vertical section of a second alternative embodiment of the capsule of FIG. 4.

In particular, in the preferred embodiment, as shown in FIGS. 4, 5 and 6, the supporting element 13 is a hollow single-piece structure with a shape that is substantially conical (FIGS. 4 and 5), or substantially dome-shaped having the profile of a semi-circle (FIG. 6), comprising at the base a substantially annular resting portion 14 which can rest at the lower wall 3 advantageously perimetrically surrounding the central portion 8. In that embodiment the volume of the compartment 12 is substantially equivalent to that of the cavity of the supporting element 13 which therefore forms the compartment 12 and delimits it together with the central portion 8 of the lower wall 3.

In an alternative embodiment (not illustrated) the supporting element 13 may instead be composed of two or more elongate rigid or semi-rigid elements, each of which if necessary may have its ends connected to a circular base ring to form a basket or a cage which rests on the capsule 1 lower wall 3 and which is in contact with the filter 9, at the projection 10, by means of the elongate elements. In that embodiment the supporting element 13 does not substantially interfere with the volume of the compartment 12 which is mainly delimited (as well as by the central portion 8 of the lower wall 3) by the projection 10 (or rather by its parts positioned between the various elongate elements).

However, preferably, the supporting element 13 is constrained in its position in such a way that it cannot substantially shift relative to the lower wall 3, always remaining at the central portion 8 of it. The supporting element 13 may be held in position by the filter 9 itself and in particular by the projection 10 which, as indicated, is advantageously and substantially shaped to match the supporting element 13.

Moreover, in addition or alternatively, on the lower wall 3 there may be a groove (not illustrated) for constraining the supporting element 13 at a resting portion 14 of it. Alternatively, the supporting element 13 may be fixed to the lower wall 3, preferably at the resting portion 14, or it may be an integral part of the lower wall 3.

As shown in FIGS. 4, 5 and 6, the sheet of flexible material, at the projection 10, is shaped in such a way that it rests substantially evenly on the supporting element 13. In some embodiments the supporting element 13 may be fixed to the sheet of flexible material. Fixing may be achieved by gluing or sealing or in other substantially known ways.

In the preferred embodiment the supporting element 13 advantageously acts as a means of protection for the filter 9, at the projection 10, against the possible action of a piercing element (which may also be an element designed to cut or tear), since the supporting element 13, once the piercing element has penetrated inside the compartment 12, is interposed between the piercing element and the filter 9.

Moreover, advantageously the supporting element 13 allows fluid communication between the compartment 12 and the rest of the chamber 7, through the filter 9, in such a way that the beverage, made during use after the interaction of the water injected and the powdered food substance, can pass, through the filter 9, from the region of the chamber 7 where the powdered food substance is located to the compartment 12, and then flow out of the capsule 1 at the central portion 8 of the lower wall 3.

The fluid communication can be achieved using various methods. For example, with reference to the preferred embodiment of the supporting element 13, it comprises openings 15, visible in FIGS. 4, 5 and 6, through which the fluid communication is possible. In the accompanying drawings, said openings 15 are configured like slots extending mainly vertically which extend towards the lower wall 3 substantially as far as the resting portion 14 of the supporting element 13, which is consequently interrupted at them.

As already indicated, the capsule 1 according to this invention may be used in beverage making systems based on capsules in which water injection means pierce the lid 6 of the capsule 1 to inject water into it, and in which the beverage extraction means allow piercing, tearing or cutting of the lower wall 3 of the capsule 1, at the central portion 8, for allowing the outflow of the beverage produced following the interaction between the water and the powdered food substance. In particular, a piercing element may penetrate through the lower wall 3, at the central portion 8, and be inserted in the compartment 12 (located below the projection 10) which has dimensions such that it is compatible with the travel of the piercing element, which therefore cannot make contact with and damage the filter 9. In the second embodiment of the capsule 1 according to this invention, the supporting 13 advantageously rules out contact between the portion of the filter 9 corresponding to the projection 10 and the piercing element, on one hand preventing yielding of the projection 10 itself, and on the other hand, in some embodiments, advantageously acting as a means of protection, being interposed between the projection 10 and the piercing element.

The beverage made in the chamber 7 can pass through the filter 9, and through the openings 15 made in the supporting element 13 when present, to enter the compartment 12 and consequently flow out through the gap created by a piercing element at the central portion 8 or through a channel made in the piercing element itself if it is designed to remain inserted in the compartment 12 for the duration of beverage dispensing.

This invention brings important advantages. The capsule according to this invention allows the use of a filter composed of an inexpensive sheet of flexible material, for example paper, although it can be used according to various methods for piercing or cutting the lower wall. In particular, thanks to the fact that the filter comprises a projection which creates a compartment suitable for receiving a piercing element, the filter remains intact even after the piercing element has penetrated inside the compartment, through the lower wall. In this way, the piercing element of a beverage making system suitable for using the capsule according to this invention can penetrate the capsule, remaining inside it during beverage dispensing, or it may be disassociated from the capsule lower wall immediately after piercing it. Said advantages translate into improved usability of the capsule according to this invention, since it allows users to make good quality beverages, in any case and with any method of penetration of the lower wall, guaranteeing the substantial absence of powder in the beverage dispensed.

In addition, there is the advantage of simple production of the capsule itself, deriving from the fact that the filter used has very low production difficulties and costs, comparable to those of prior art capsules which use a simple fabric disk as the filter.

Finally, it should be noticed that this invention is relatively easy to produce and that even the cost linked to implementing the invention is not very high.

The invention described above may be modified and adapted in several ways without thereby departing from the scope of the inventive concept.

Moreover, all details of the invention may be substituted with other technically equivalent elements and the materials used, as well as the shapes and dimensions of the various components, may vary according to requirements.

What is claimed is:

1. A capsule containing at least one powdered food substance which can be extracted by passing water through the at least one powdered food substance to make a beverage, comprising:

a substantially cup-shaped body comprising a lower wall and a lateral wall;

a lid fixed to the body of the capsule at an edge of the lateral wall located on the opposite side to the lower wall;

between said lid and the inner surface of the capsule body there being a chamber for containing the at least one powdered food substance;

the lid being in use pierceable to allow injection of water into the chamber, and the lower wall being in use pierceable at a central portion of the lower wall to allow extraction of a beverage from the capsule;

a filter positioned inside the chamber close to the lower wall, the filter being constituted of a sheet of flexible material directly fixed to the body at an annular portion of the capsule body which surrounds the central portion, the sheet of flexible material including one layer or two or more superposed layers of a flexible material adapted to be rolled up on itself and folded over itself, said filter separating the at least one powdered food substance at least from the central portion of the lower wall, being permeable to the beverage and substantially preventing passage of the at least one powdered food substance, said sheet of flexible material also being shaped to form, substantially at the central portion of the lower wall, at least one projection towards the lid where the filter is distanced from the central portion of the lower wall, and wherein said at least one projection delimits with the central portion an empty compartment wherein, during use, a piercing element can be inserted following penetration through the central portion of the lower wall, without damaging the filter;

said at least one projection supporting itself, and wherein a volume of space is defined between the filter and a part of the capsule body bordered by said annular portion, said volume of space being empty.

2. The capsule according to claim 1, characterised in that the sheet of flexible material extends substantially on the entire surface of the lower wall and rests on the latter except at the central portion where there is the projection.

3. The capsule according to claim 2, characterised in that said flexible material is paper, or fabric, or non-woven fabric, or a plastic film.

4. The capsule according to claim 1, characterised in that the projection has a substantially conical shape or is substantially dome-shaped.

5. The capsule according to claim 1, characterised in that said flexible material is paper, or fabric, or non-woven fabric, or a plastic film.

* * * * *